US005452778A

United States Patent [19]

Wang

[11] Patent Number: 5,452,778

[45] Date of Patent: Sep. 26, 1995

[54] RETRACTABLE LUGGAGE CARRYING HANDLE POSITIONING DEVICE

[76] Inventor: JinJing-Sheng Wang, No. 569, Ching Kuo Rd., Ta Chia Chien, Taichung Hsien, Taiwan

[21] Appl. No.: 179,938

[22] Filed: Jan. 11, 1994

[51] Int. Cl.[6] ..... A45C 5/14; A45C 13/26

[52] U.S. Cl. ..... 190/115; 190/18 A; 16/115; 280/37; 280/655

[58] Field of Search ..... 190/18 A, 18 R, 190/39, 115; 280/47.29, 655, 655.1, 37, 47.315, 47.371; 16/115

[56] References Cited

U.S. PATENT DOCUMENTS

| | | | |
|---|---|---|---|
| 4,185,936 | 1/1980 | Takahashi | 16/115 X |
| 4,256,320 | 3/1981 | Hager | 16/115 X |
| 4,261,447 | 4/1988 | Arias et al. | 16/115 X |
| 4,616,379 | 10/1986 | Lio | 16/115 X |
| 4,793,646 | 12/1988 | Michaud, Jr. | 16/115 X |
| 5,167,306 | 12/1992 | Carrigan, Jr. | 190/115 X |
| 5,199,811 | 4/1993 | Huang | 280/655 X |
| 5,294,145 | 3/1994 | Cheng | 280/655 X |
| 5,295,565 | 3/1994 | Latshaw | 190/102 X |
| 5,323,886 | 6/1994 | Chen | 190/18 A |
| 5,323,887 | 6/1994 | Scicluna et al. | 190/115 X |

FOREIGN PATENT DOCUMENTS

| | | | |
|---|---|---|---|
| 3046286 | 7/1982 | Germany | 16/115 |

*Primary Examiner*—Sue A. Weaver
*Attorney, Agent, or Firm*—Bacon & Thomas

[57] ABSTRACT

A retractable luggage carrying handle positioning device comprised of two outer tubes connected between two tubular mounting blocks on an upper mounting frame and two tubular mounting blocks on a lower mounting frame, two inner tubes linked by a hand grip and made to slide in two outer tubes, wherein two friction blocks are retained in a respective hole on either tubular mounting block on the upper mounting frame and controlled by a toothed lever to stop against either inner tube in holding it at the desired position.

1 Claim, 6 Drawing Sheets

RETRACTABLE LUGGAGE CARRYING HANDLE POSITIONING DEVICE

BACKGROUND OF THE INVENTION

The present invention relates to a retractable luggage carrying handle positioning device which can be conveniently operated to lock the retractable carrying handle of a luggage at a desired length.

Luggage generally has a carrying handle for carrying with the hand while moving on the ground. In order to minimize the storage space, this carrying handle is commonly made retractable. FIG. 1 illustrates a structure of a retractable luggage carrying handle according to the prior art, which is generally comprised of two mounting frames transversely fastened to the back panel of the luggage at different elevations, two outer tubes connected between the mounting frames, two inner tubes made to slide in the outer tubes and linked by a hand grip outside the outer tubes, and two lock rings respectively mounted on the outer tubes at the top. The inner tubes have a respective stop member at the bottom which engages with either lock ring as the inner tubes are pulled out of the outer tubes. This structure of a retractable luggage carrying handle is not satisfactory in function. Because the inner tubes can be locked in position only when they are completely pulled out of the outer tubes, the handle cannot be adjusted to the desired length. Another drawback of this structure of retractable luggage carrying handle is that the inner tubes may be forced to move back inside the outer tubes as the luggage is suddenly stopped.

SUMMARY OF THE INVENTION

The present invention has been accomplished under the aforesaid circumstances. It is therefore an object of the present invention to provide a retractable luggage carrying handle positioning device for a retractable luggage carrying handle which permits the handle to be conveniently adjusted to the desired length and then set in position. It is another object of the present invention to provide a retractable luggage carrying handle positioning device for a retractable luggage carrying handle which can firmly lock the handle in the adjusted position.

According to one aspect of the present invention, the retractable luggage carrying handle positioning device is comprised of two outer tubes connected between two tubular mounting blocks on an upper mounting frame and two tubular mounting blocks on a lower mounting frame, two inner tubes linked by a hand grip and made to slide in two outer tubes, wherein two friction blocks are retained in a respective hole on either tubular mounting block on the upper mounting frame and controlled by a toothed lever to stop against either inner tube in holding it at the desired position. According to another aspect of the present invention, each inner tube has a bottom end fastened with a tubular stop member on the outside, and each outer tube has two inward projections on the inside at different elevations which alternatively act with the tubular stop member on the respective inner tube to limit the moving range of the respective inner tube in the respective outer tube.

DETAILED DESCRIPTION OF THE PREFERRED EMBODIMENT

Figure 1:
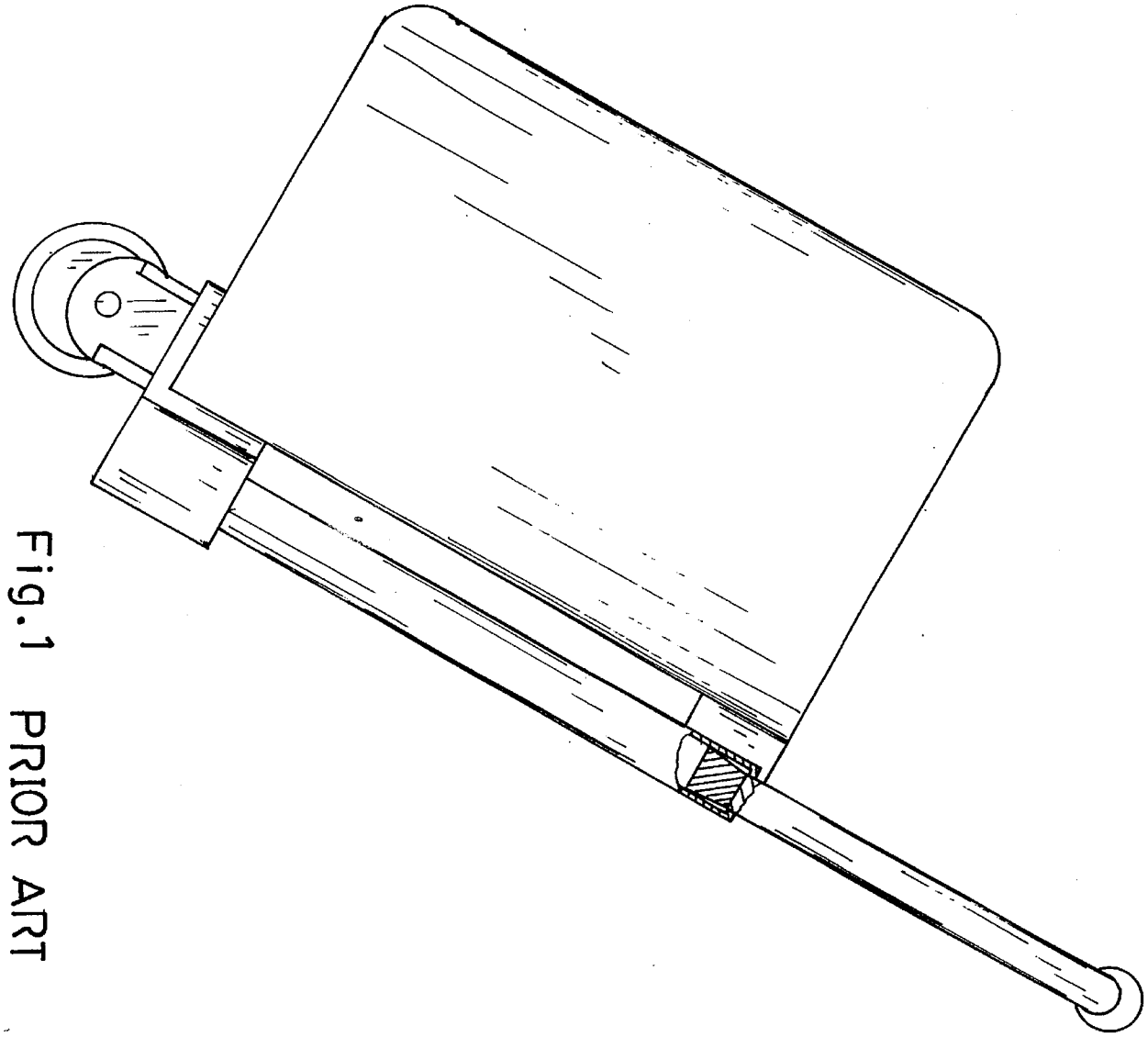
Fig.1 PRIOR ART
FIG. 1 shows a retractable luggage carrying handle installed in a luggage according to the prior art.
Figure 2:
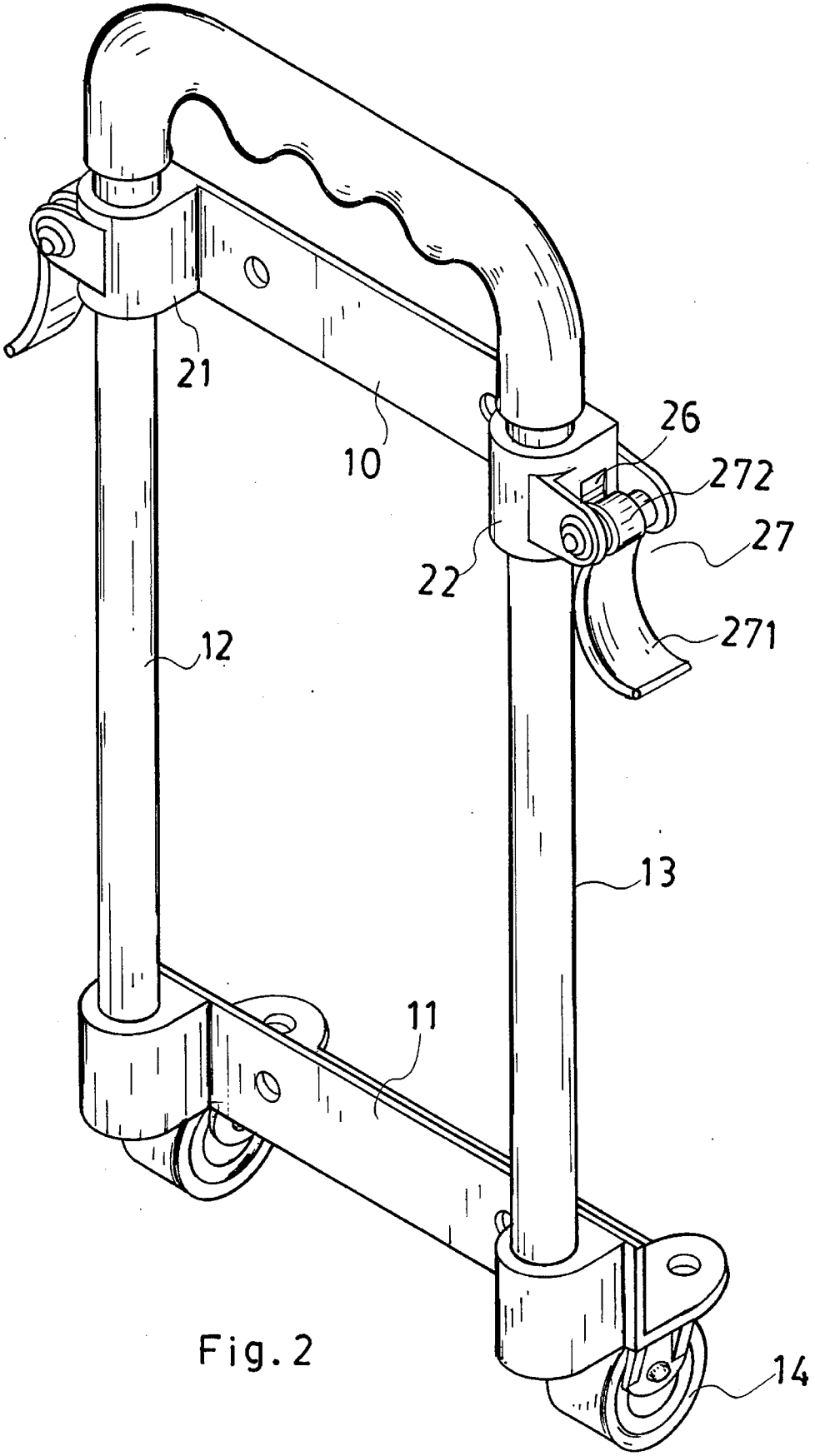
FIG. 2 is an elevational view of a retractable luggage carrying handle positioning device according to the preferred embodiment of the present invention.
Figure 3:
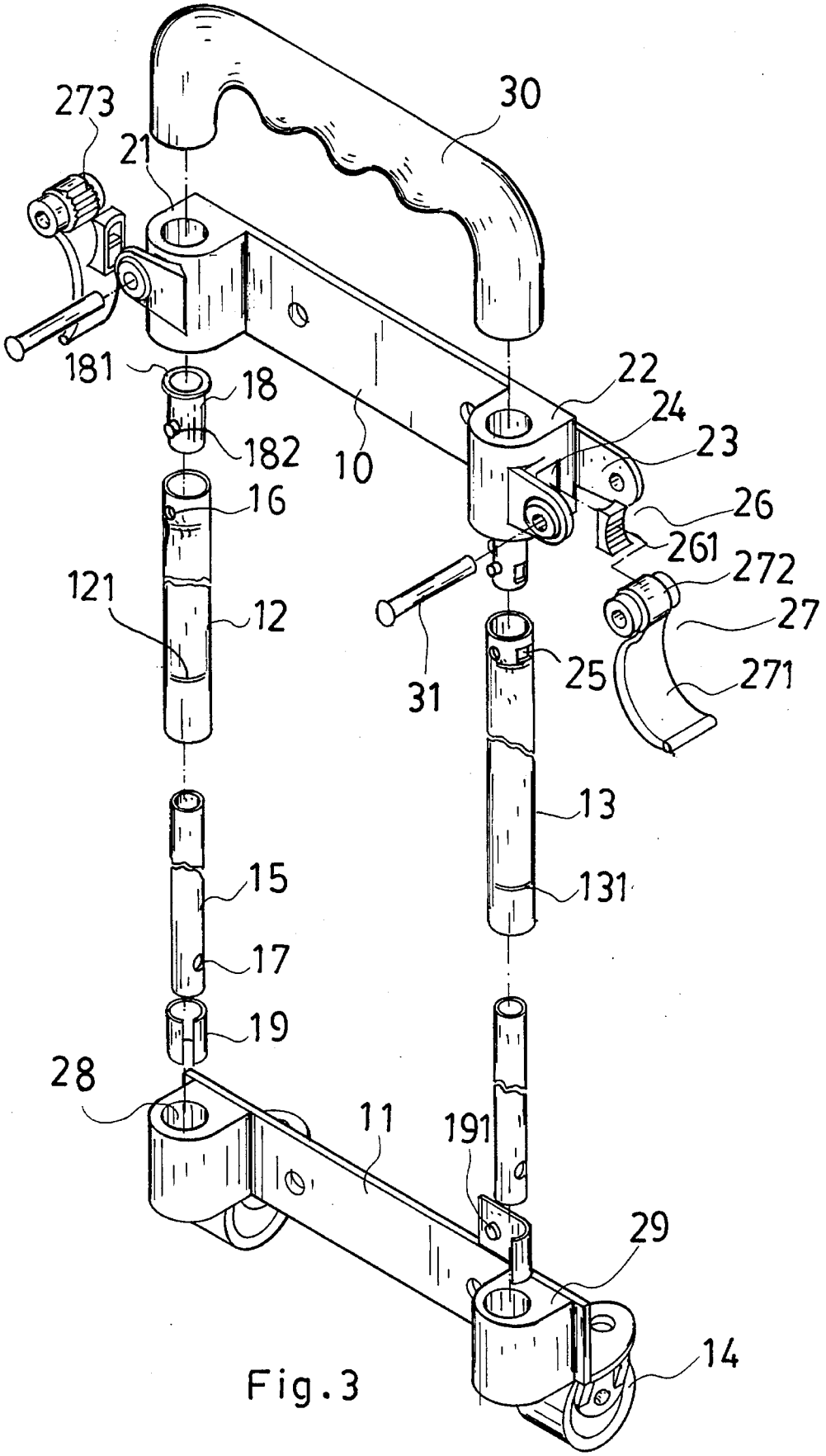
FIG. 3 is an exploded view of the retractable luggage carrying handle positioning device shown in FIG. 2.
Figure 4:
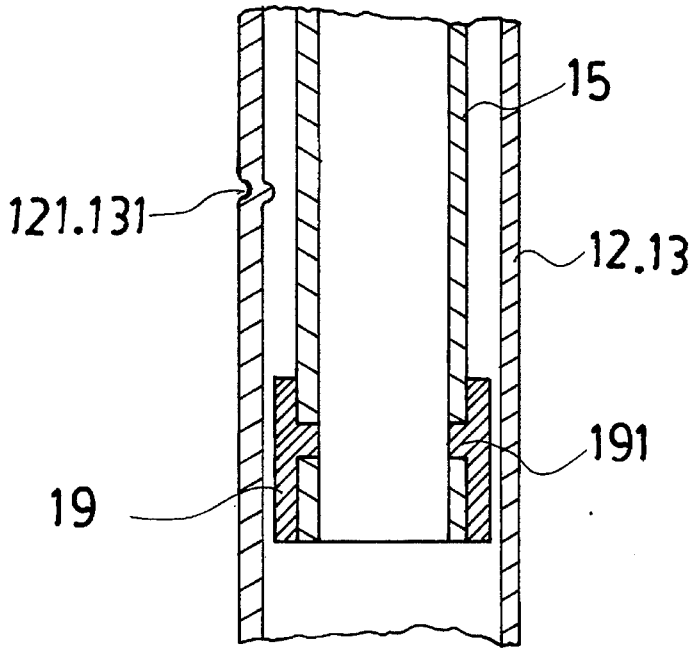
FIG. 4 is a partial sectional view of the retractable luggage carrying handle positioning device of FIG. 2 showing the position of an inward projection on the outer tube thereof.
Figure 5:
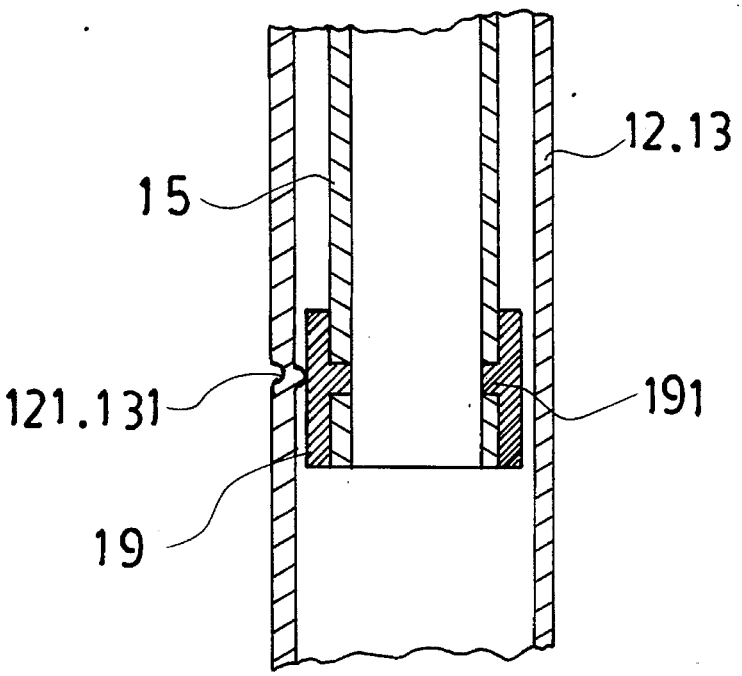
FIG. 5 is similar to FIG. 4 but showing the inward projection engaging into the outside surface of the tubular stop member on the bottom end of the respective inner tube to stop the respective inner tube in position.

Referring to FIGS. 2, 3, the preferred embodiment of the present invention is generally comprised of an upper mounting frame 10, a lower mounting frame 11, two outer tubes 12;13, and two inner tubes 15. The lower mounting frame 11 has wheels 14 fastened thereto at the bottom, and two tubular mounting blocks 28 on two opposite ends thereof. The upper mounting frame 10 comprises two tubular mounting blocks 21;22 on two opposite ends thereof. The outer tubes 12;13 have a respective top end connected to either tubular mounting block 21 or 22 of the upper mounting frame 10 by a respective tubular end member 18, and a respective bottom end connected to either tubular mounting block 28 or 29 of the lower mounting frame 11. The tubular end member 18 is fastened to either tubular mounting block 21 or 22 of the upper mounting frame 10 and inserted into either outer tube 12 or 13, having an outward top flange 181 stopped above either outer tube 12 or 13 and two opposite pegs 182 respectively engaged into respective holes 16 on either outer tube 12 or 13. The inner tubes 15 have a respective top end linked to each other by a hand grip 30 disposed above the tubular mounting blocks 21;22 of the upper mounting frame 10, and a respective bottom end inserted through either tubular mounting block 21 or 22 of the upper mounting frame 10 and either tubular end member 18 into either outer tube 12 or 13. A stop member 19 is respectively mounted around the bottom end of each inner tube 15 and moved by the respective inner tube 15 to slide within the respective outer tube 12 or 13. When the inner tubes 15 are pulled out of the outer tubes 12;13 by the hand grip 30, the stop member 19 on either inner tube 15 is respectively stopped against the tubular end member 18 on either outer tube 12 or 13, and therefore the inner tubes 15 are stopped from escaping out of the outer tubes 12;13. The stop member 19 is a short split tube having raised portions 191 on the inside wall thereof. By engaging the raised portions 191 into respective holes 17 on either inner tube 15, the stop member 19 is fastened around the bottom end of either inner tube 15.

Figure 6:
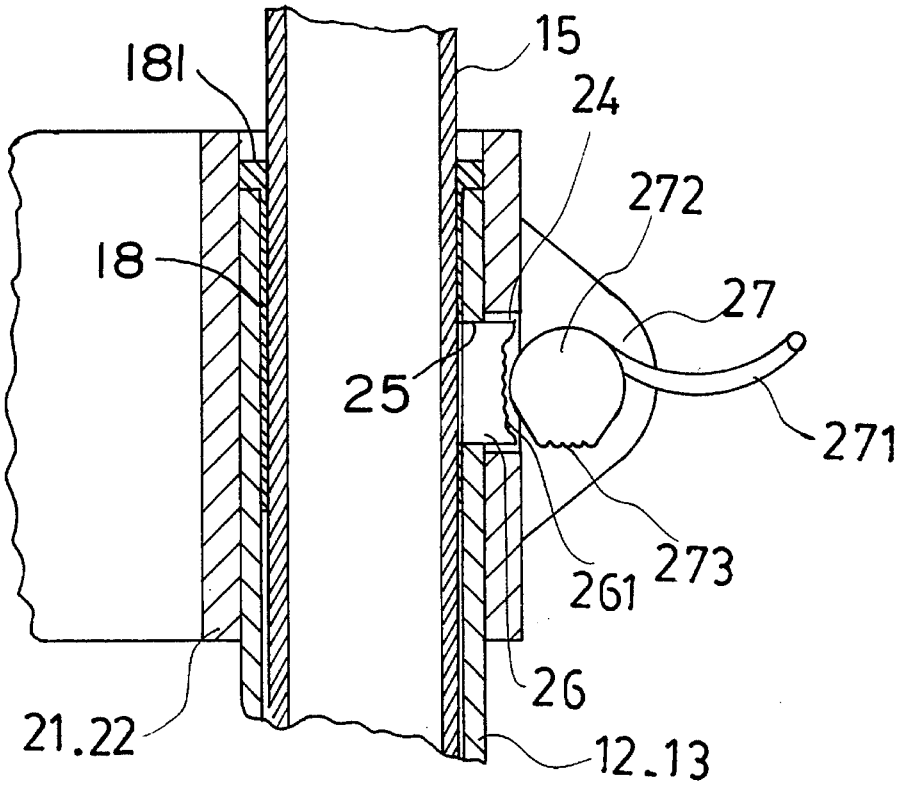
FIG. 6 is a partial sectional view of the retractable luggage carrying handle positioning device of FIG. 2 showing the locking mechanism thereof unlocked.
Figure 7:
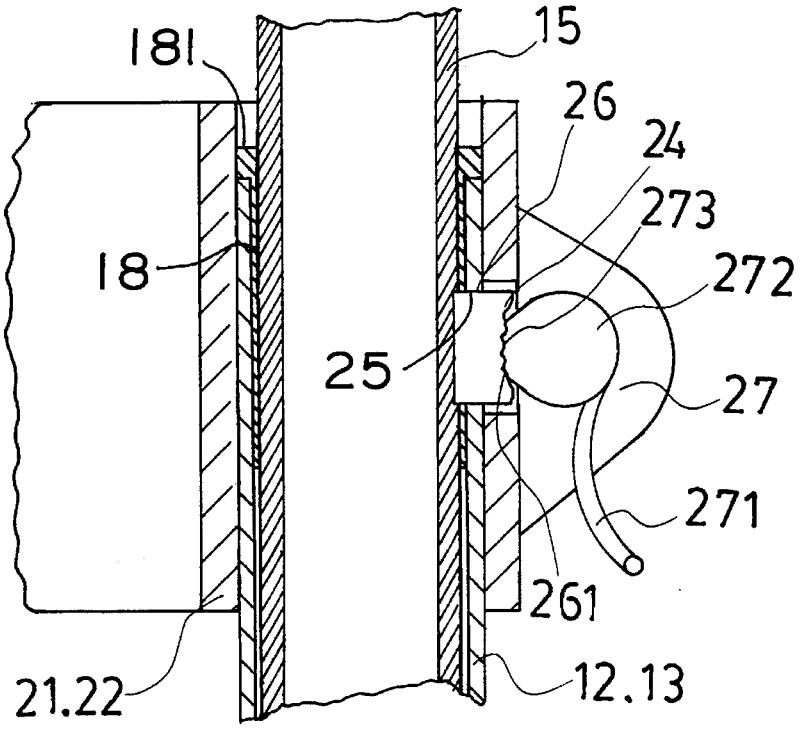
FIG. 7 is similar to FIG. 6 but showing the locking mechanism locked to stop the respective inner tube in position.

Referring to FIGS. 6 and 7 and FIGS. 2 and 3 again, a locking mechanism is made on each end of the upper mounting frame 10 and controlled to lock either inner tube in position. As shown in the drawing, the upper mounting frame 10 comprises two opposite pairs of lugs 23, two levers 27 respectively pivoted about a respective pivot 31 between either pair of lugs 23, two friction blocks 26 respectively received in a respective hole 24 on either tubular mounting block 21 or 22 of the upper mounting frame 10 and disposed between either inner tube 15 and either lever 27. The outer tube 12 or 13 has an opening 25 aligned with the hole 24 on either tubular mounting block 21 or 22 of the upper mounting frame 10 for passing the respective friction block 26. The friction block 26 has a toothed portion 261 on a curved outer wall thereof. The lever 27 has one end terminated to a tubular rod 272 mounted around the pivot 31 between either pair of lugs 23 on the upper mounting frame 10 and an opposite end terminated to a finger rod 271. The tubular rod 272 has a series of teeth 273 spaced around the periphery. Turning the finger rod 271 in one direction causes the series of teeth 273 of the tubular rod portion 272 to engage with the toothed portion 261 on the respective friction block 26, and therefore the friction block 26 is forced against the respective inner tube 15 causing it to be stopped in position. The outer tube 12 or 13 further comprises two inward projections 121;131 at different elevations, which are formed by making two dents on the outside surface of the outer tube 12 or 13 through a punching process. The inward projection 121 or 131 engages the outside surface of the stop member 19 on either inner tube 15 to hold the inner tube 15 in position as the lever 27 is released from the respective friction block 26.

Referring to FIGS. 6 and 7, when the lever 27 is not turned, the friction block 26 and the series of teeth 273 of the lever 27 are separated from each other, and a small gap is still maintained between the friction block 26 and the respective inner tube 15. When the lever 27 is turned downwards, the series of teeth 273 on the tubular rod portion 272 of the lever 27 becomes engaged with the toothed portion 261 of the friction block 26 causing the friction block 26 to tightly stop against the outside surface of the respective inner tube 15, and therefore the respective inner tube 15 is stopped in position.

Figure 8:
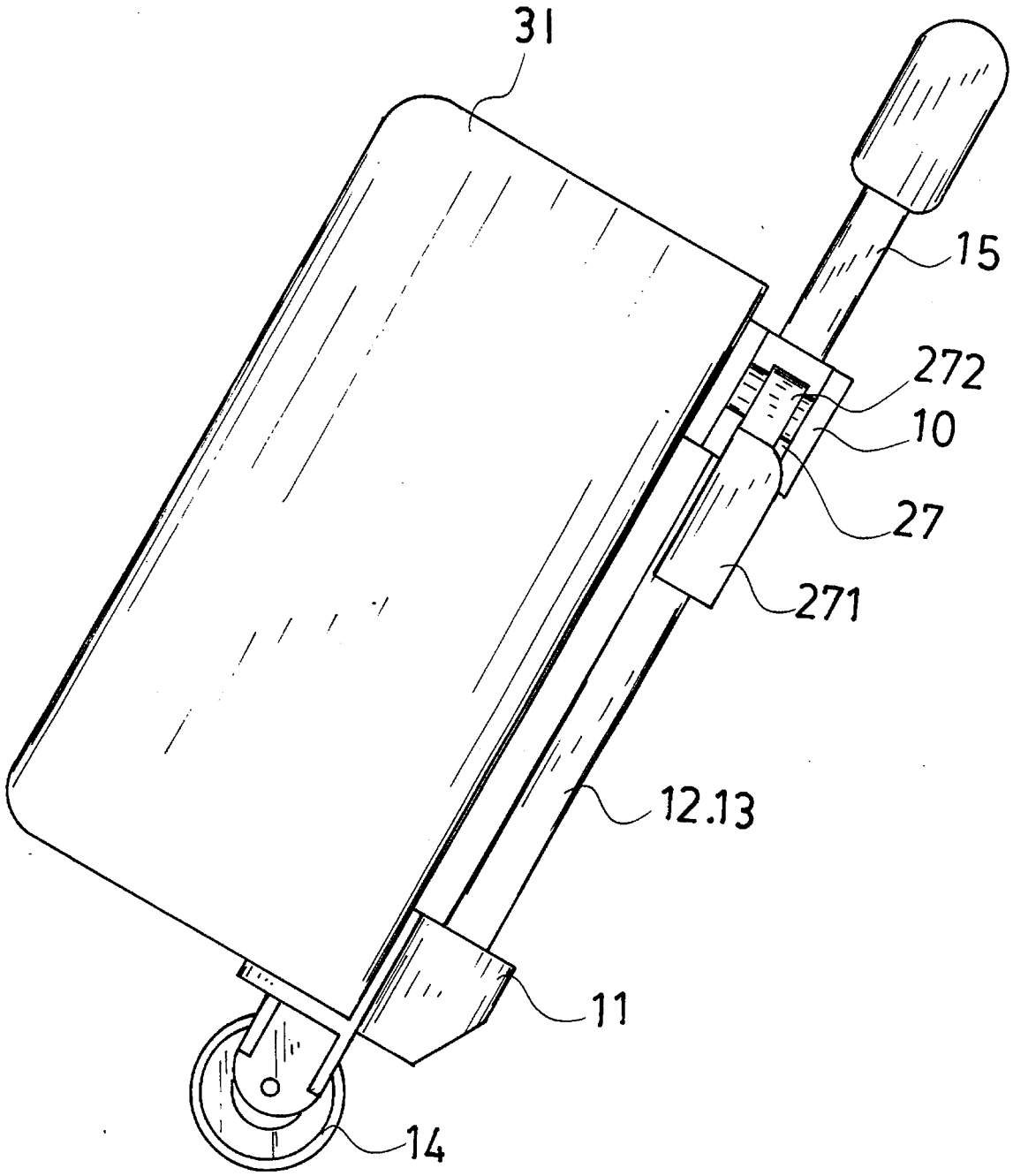
FIG. 8 is an installed view showing the retractable luggage carrying handle positioning device installed in a luggage.

Referring to FIG. 8, the upper and lower mounting frames 10;11 are respectively fastened to luggage 31 at the back, and therefore the luggage 31 can be carried on the wheels 14 on the lower mounting frame 11. When in use, the levers 27 are turned upwards to release the friction blocks 26 for permitting the inner tubes 15 to be pulled out of the outer tubes 12;13 by the hand grip 30 at the desired length, and then the levers 27 are turned downwards to their former positions causing the inner tubes 15 to be stopped in position. Therefore, by means of the control of the levers 27, the retractable handle can be set at a desired length.

I claim:

1. A retractable luggage carrying handle positioning device comprising: an upper mounting frame transversely fastened to a luggage at an upper elevation and having two first tubular mounting blocks; a lower mounting frame transversely fastened to said luggage at a lower elevation and having two second tubular mounting blocks; two parallel outer tubes having a respective top end fastened to a first tubular mounting block of said upper mounting frame and a respective bottom end fastened to a second tubular mounting block of said lower mounting frame; a hand grip having two opposite ends; two inner tubes each having a respective bottom end inserted through a first tubular mounting block of said upper mounting frame into an outer tube and a respective top end connected to one end of said hand grip; a tubular end member extending into the top end of each outer tube so as to permit the top end of the respective inner tube to pass therethrough; a tubular stop fastened onto the bottom end of each inner tube which stops against the tubular end member on the top end of the respective outer tube to limit the stroke of the respective inner tube relative to the outer tube, the tubular stop having an outer surface; two inward projections extending inwardly on each outer tube at different elevations, which permit the respective inner tube to slide in the respective outer tube and which engage the outer surface of the tubular stop member of the respective inner tube; two locking devices to lock said inner tubes at a desired length as said inner tubes are pulled out of said outer tubes by said hand grip, each locking device comprising:

(i) two parallel lugs respectively and horizontally extending outwards from a first tubular mounting block of said upper mounting frame;

(ii) aligned holes defined by the first tubular mounting blocks and the top ends of the outer tubes located between the two parallel lugs;

(iii) a friction block received in the aligned holes on a first tubular mounting block of said upper mounting frame, said friction block having a smooth inner wall in contact with an inner tube and a curved, toothed outer wall disposed outside the respective tubular mounting block;

(iv) a pivot mounted between said parallel lugs; and (v) a lever having a tubular rod portion pivoted about said pivot and an end terminating in a finger rod, said tubular rod portion of said lever having a series of teeth around a portion of a periphery thereof, the teeth on said tubular rod portion of said lever engaged with the toothed portion of said friction block causing said friction block to tightly stop against the respective inner tube to hold it in position as said lever is turned in one direction, the teeth on said tubular rod portion of said lever being disengaged from the toothed portion of said friction block causing said friction block to release the respective inner tube as said lever is turned in the reverse direction.

* * * * *